US010010748B1

(12) United States Patent
Weinstein et al.

(10) Patent No.: US 10,010,748 B1
(45) Date of Patent: Jul. 3, 2018

(54) TREADMILL HAVING TEXTURED TREAD SURFACES

(71) Applicant: Samsara Fitness LLC, Chester, CT (US)

(72) Inventors: Brian Weinstein, Essex, CT (US); Jeffrey Vernon, Essex, CT (US)

(73) Assignee: SAMSARA FITNESS LLC, Chester, CT (US)

( * ) Notice: Subject to any disclaimer, the term of this patent is extended or adjusted under 35 U.S.C. 154(b) by 0 days.

(21) Appl. No.: 15/130,997

(22) Filed: Apr. 17, 2016

Related U.S. Application Data

(60) Provisional application No. 62/149,347, filed on Apr. 17, 2015.

(51) Int. Cl.
*A63B 22/02* (2006.01)

(52) U.S. Cl.
CPC ..... *A63B 22/0285* (2013.01); *A63B 22/02* (2013.01); *A63B 2209/00* (2013.01)

(58) Field of Classification Search
CPC ..... A63B 21/00058; A63B 21/00061; A63B 21/00065; A63B 21/00178; A63B 21/00181; A63B 21/00185; A63B 21/00189; A63B 21/002; A63B 21/0023; A63B 21/02; A63B 21/028; A63B 21/04; A63B 21/0407; A63B 21/0414; A63B 21/0421; A63B 21/0428; A63B 21/0435; A63B 21/0442; A63B 21/05; A63B 21/0604; A63B 21/0607; A63B 21/068; A63B 21/16; A63B 21/4023; A63B 21/4027; A63B 21/4033; A63B 21/4034; A63B 21/4037; A63B 21/4045; A63B 21/4049; A63B 22/0046; A63B 22/02; A63B 22/0207; A63B 22/0285; A63B 23/035; A63B 23/03516; A63B 23/04; A63B 23/0405; A63B 23/0464; A63B 23/047; A63B 23/0482; A63B 23/0494; A63B 69/0028; A63B 69/0035; A63B 2069/0031; A63B 71/0054; A63B 2071/0063; A63B 2071/0072;
(Continued)

(56) References Cited

U.S. PATENT DOCUMENTS 1,211,765 A 1/1917 Schmidt
3,642,279 A 2/1972 Cutter
(Continued)

FOREIGN PATENT DOCUMENTS

EP 2540354 A2 * 1/2013 ..... A63B 22/02

*Primary Examiner* — Andrew S Lo
*Assistant Examiner* — Gary D Urbiel Goldner
(74) *Attorney, Agent, or Firm* — Charles Nessler

(57) ABSTRACT

A treadmill has tread comprised of slats running as a loop between a front roller and a rear roller. The tread is comprised of multiplicity of slats, each comprising a base and a cover which is detachably or permanently attached to the base. The base provides structural strength to support the weight of a user running on the treadmill. The cover of each slat is non-structural and presents to a user's foot one of several surface textures, such as simulated turf grass, simulated outdoor track cobbles, or gym mat. In each slat, the cover has a Shore A Durometer hardness of 50-70, which hardness is less than the hardness of the base.

5 Claims, 5 Drawing Sheets

(58) Field of Classification Search
CPC ..... A63B 2071/009; A63B 2208/0204; A63B 2209/00; A63B 2209/10
See application file for complete search history.

(56) References Cited

U.S. PATENT DOCUMENTS

| | | | | | |
|---|---|---|---|---|---|
| 4,334,676 | A * | 6/1982 | Schonenberger | A63B 22/02 | 482/54 |
| 4,614,337 | A * | 9/1986 | Schonenberger | A63B 22/02 | 482/54 |
| 4,616,822 | A * | 10/1986 | Trulaske | A63B 22/02 | 198/841 |
| 5,385,520 | A | 1/1995 | Lepine | | |
| 5,577,598 | A | 11/1996 | Schoenenberger | | |
| 5,660,550 | A | 8/1997 | Roche | | |
| 6,042,514 | A * | 3/2000 | Abelbeck | A63B 22/02 | 198/439 |
| 6,095,952 | A * | 8/2000 | Ali | A63B 22/02 | 482/35 |
| 6,348,025 | B1 | 2/2002 | Schoenenberger | | |
| 7,976,437 | B1 * | 7/2011 | von Detten | A63B 22/0235 | 482/54 |
| 8,343,016 | B1 | 1/2013 | Astilean | | |
| 2004/0192511 | A1 * | 9/2004 | Ein-Gal | A61H 7/001 | 482/54 |
| 2005/0170935 | A1 * | 8/2005 | Manser | A63B 26/003 | 482/54 |
| 2007/0060451 | A1 * | 3/2007 | Lucas | A61H 7/001 | 482/54 |
| 2007/0072743 | A1 * | 3/2007 | Severino | A63B 22/0242 | 482/54 |
| 2007/0298937 | A1 * | 12/2007 | Shah | A63B 22/02 | 482/54 |
| 2008/0009396 | A1 * | 1/2008 | von Detten | A63B 22/02 | 482/54 |
| 2008/0176719 | A1 * | 7/2008 | To | A63B 22/0235 | 482/54 |
| 2010/0269305 | A1 * | 10/2010 | Payne | D01B 1/04 | 19/48 R |
| 2011/0111166 | A1 * | 5/2011 | Chang | A63B 22/02 | 428/105 |
| 2011/0152037 | A1 * | 6/2011 | Wu | A63B 22/0207 | 482/54 |
| 2012/0010048 | A1 | 1/2012 | Bayerlein | | |
| 2012/0010053 | A1 * | 1/2012 | Bayerlein | A63B 21/0053 | 482/54 |
| 2012/0184413 | A1 * | 7/2012 | Lo | A63B 22/0235 | 482/54 |
| 2013/0263418 | A1 * | 10/2013 | Johnson, Jr. | A63B 22/02 | 29/402.08 |
| 2014/0011642 | A1 * | 1/2014 | Astilean | A63B 22/02 | 482/54 |
| 2015/0051050 | A1 * | 2/2015 | Huang | A63B 22/0285 | 482/54 |

* cited by examiner

FIG. 7
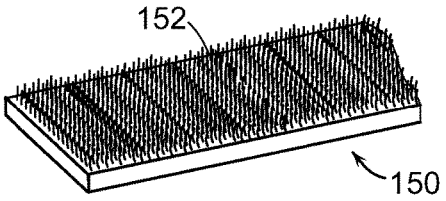
FIG. 8
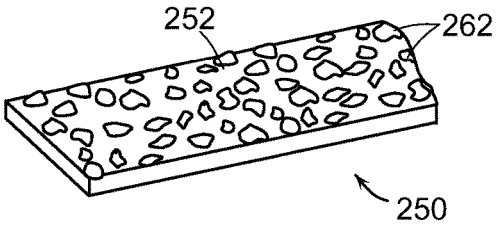
FIG. 9
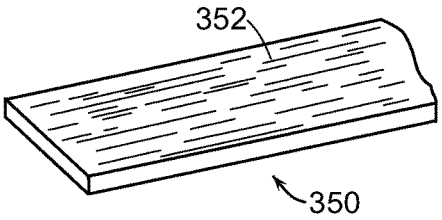
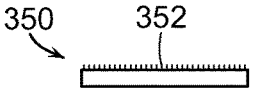
FIG. 10
FIG. 11
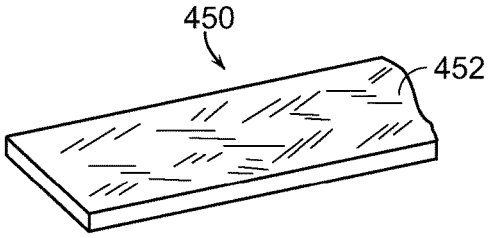

TREADMILL HAVING TEXTURED TREAD SURFACES

TECHNICAL FIELD

The present invention relates to treadmills, in particular to foot-powered treadmills.

BACKGROUND

The present invention relates to improvements in treads used on foot powered treadmills, optionally on motor powered treadmills, where the tread is comprised of a series of interconnected slats. Pat. App. Publication 2012/0010048 of Bayerlein et al. describes a foot powered treadmill with a slatted tread. U.S. Pat. No. 5,577,598 of Schoenenberger describes a motorized treadmill.

In a foot powered treadmill, a runner's foot-force applied to the typically concave upper surface of the tread causes the tread to move around rollers at the front and back of the treadmill. Thus it is important that a runner's foot have good frictional engagement with the tread.

In prior art foot powered treadmills, slats have been made of metal or molded plastic. Some prior art treads have comprised a structural metal or plastic portion, the top of which is covered with a layer of unyielding thermoplastic elastomer. Heretofore, the top surfaces of typical slats, which present a running surface to a runner's foot, have been relatively smooth; that is, they have had light texturing or roughening, and sometimes are lightly embossed with a decorative logo or name.

Running on a treadmill might be purely for the exercise, with the treadmill providing several conveniences compared to finding and running on a track, on a grassy field, or on a trail that runs through a park or woods. Often, running on a treadmill is a runner's way of conveniently preparing himself or herself for a run on a track or trail or turf. When that is the case, a plain rubberized surfaces on the treads of the prior art have not been well-simulative of the surface of an actual track or trail surface, and have presented a different feel. The present invention fills the need for a treadmill which is more simulative of an actual running experience.

SUMMARY

An object of the invention is to provide a treadmill having a slatted tread which is simulative of different running surfaces which a runner might encounter at a track or trail or other outdoor venue. A further object of the invention is to provide a means for a converting a slatted treadmill from one kind of simulative tread surface to another.

In accord with embodiments on the invention a treadmill has a tread comprised of a plurality of interconnected slats, where each slat is comprised of a structural base and a cover attached to the base by one or more of various attachment means. A cover embodiment is made of plastic and/or rubber base material and presents a slat surface to the runner which is one of either simulated grass covered turf, simulated cobbles of an outdoor trail, or a mat like that of an artificial running track. In embodiments of the invention, the base is either a metal or a structural plastic, such as glass filled Nylon, and the cover is an elastomer, such as a rubber. Preferably, the base has a hardness which is substantially greater than the hardness of the cover. For example, a polymer base has a hardness of about Rockwell 120R (approximating a Durometer of 80 A to 85 A) or more, and the cover material has a Durometer of less than the hardness of the base, preferably substantially less hard than Durometer 80 A (Durometer 70 A or less), more preferably Durometer 50-60 A p.

Thus the feel of the surface which the user's feet experience is closer to that of a real surface in the field than is characteristic of prior art treadmills. At the same time, the strong polymer or metal material of the strut base provides a firm supportive structure for the runner's feet; yet the structure is able to deflect resiliently under the weight of the runners foot, providing a "give: which would not be present if the treadmill had a non-slat tread which ran over a structure, such as a steel panel, that underlays the tread.

In accord with other embodiments of the invention, a cover is attached to the base by means of adhesive. In another, the cover is molded around the base. In another approach the cover has engagement features that mate with engagement features on the top of the base. For example, the cover may have a plurality of ribs or pins that are received in slots or cavities of the base. Or the base may have ribs or pins that are received in slots or cavities on the underside of the cover.

The foregoing features and other objects, features and advantages of the present invention will become more apparent from the following description of preferred embodiments and accompanying drawings.

BRIEF DESCRIPTION OF THE DRAWINGS

FIG. 7 is a perspective view of a portion of a slat cover that is comprised of simulated grass turf.

FIG. 8 is a perspective view of a portion of a slat cover that is comprised of rubber having a cobbled surface.

FIG. 9 is a perspective view of a portion of a slat cover that is comprised of rubber having a linear textured surface.

FIG. 10 is an end view of the cover shown in FIG. 9.

FIG. 11 is a perspective view of a portion of a slat cover that is comprised of a rubber mat, such as is used on indoor and outdoor running tracks.

DESCRIPTION

This application claims benefit of provisional patent application Ser. No. 62/149,347, filed Apr. 17, 2015, the disclosure of which is hereby incorporated by reference. Foot powered treadmills are well known in the prior art. A familiar commercial foot powered treadmill comprises an endless loop tread that runs lengthwise around front and rear rollers; the tread presents an upper surface, preferably concave, upon which the runner runs. The force of the runner's feet on the tread causes the tread to move around the rollers. Foot powered treadmills are described in patent publications, including U.S. Patent Publication No. 2012/0010048 of Bayerlein et al. and U.S. Pat. No. 8,690,738 of Astilean, the disclosures of which are hereby incorporated by reference. While the preferred embodiments of the invention are described in connection with foot powered treadmills, the present invention includes motorized/powered treadmills having slat type treads.

Figure 1:
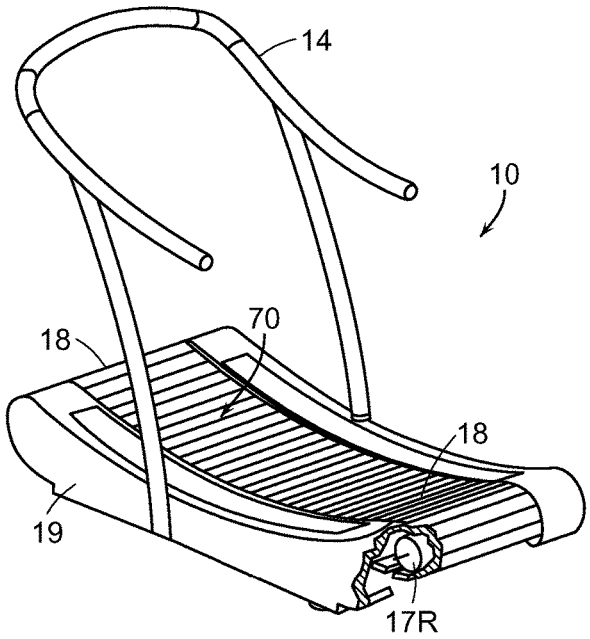
FIG. 1 is a perspective view of a foot powered treadmill.
Figure 2:
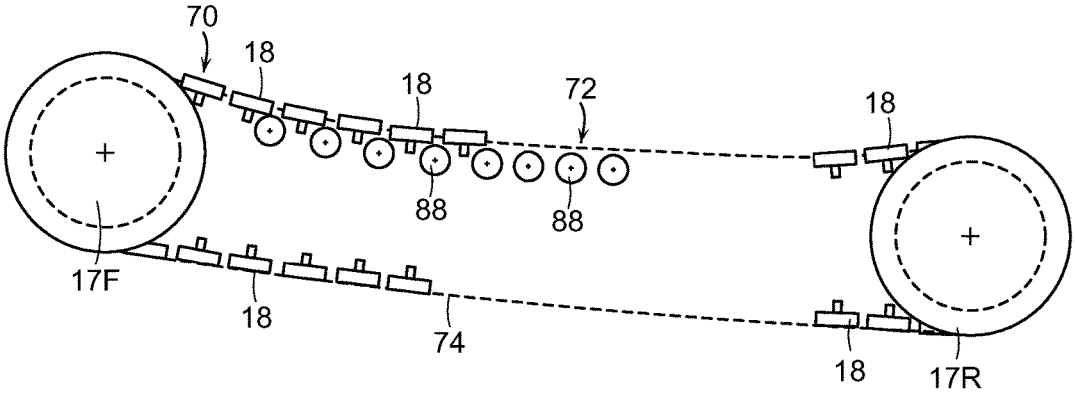
FIG. 2 is a side elevation view of the tread and front rollers of the treadmill of FIG. 1.

FIG. 1 and FIG. 2 illustrate an exemplary treadmill 10 having a tread 70, the slats 18 of which are preferably one of the embodiments of the present invention. FIG. 1 is a perspective view of treadmill 10 (which may be alternatively referred to herein as a machine). FIG. 2 is a semi-schematic left side view of the rollers and tread of treadmill 10, i.e., with the side cover 19 removed.

Treadmill 10 has a tread 70 with a concave top portion 72 which presents as a running surface during use. Tread 70 is an endless loop, running between front roller 17F and rear roller 17R. The front roller is concealed in the FIG. 1 view by the side covers and the tread. The cutaway in FIG. 1 exposes the end of rear roller 17R. FIG. 2 shows the front roller 17F, the tread loop, and rear roller 17R.

In the use of treadmill 10, a user (or "runner") runs on the top surface of the slats in the preferably concave upper portion 72 of tread 70, while facing in the direction of the closed end of optional rail 14. The upper portion 72 of the tread loop typically moves rearwardly in reaction to the force imparted by the runner's footwork. The weight and motive force applied by a runner's foot to the tread is described herein as footwork. Usually there is a one-way bearing or clutch which prevents the upper portion of the tread from moving the "wrong way", i.e., in the direction of the front roller 17F under a user's footwork. The lower portion 74 of the tread 70 runs between the bottom surfaces of the rollers 17F, 17R. During normal treadmill use the portion 74 moves toward the front of the treadmill. The lower portion of the tread is typically not accessible to a user.

Tread 70 is comprised of a plurality of interconnected slats 18 which as described below, in the present invention are comprised of a base and a cover. Typically, slats 18 are interconnected either by slat-to-slat fittings or by being attached adjacent to each other to opposing-side belts which run around the outer ends of the rollers. Preferably, a multiplicity of lengthwise-spaced apart roller bearings 88 are mounted on either side of the machine frame (not shown). The bearings support the opposing lengthwise ends of each slat as the slat moves rearwardly between the top of the front roller and the top of the rear roller. A typical slat 18 that is supported by bearings 88 near the lengthwise slat ends must have sufficient structural strength to support the footwork of a runner using the treadmill.

Figure 3:
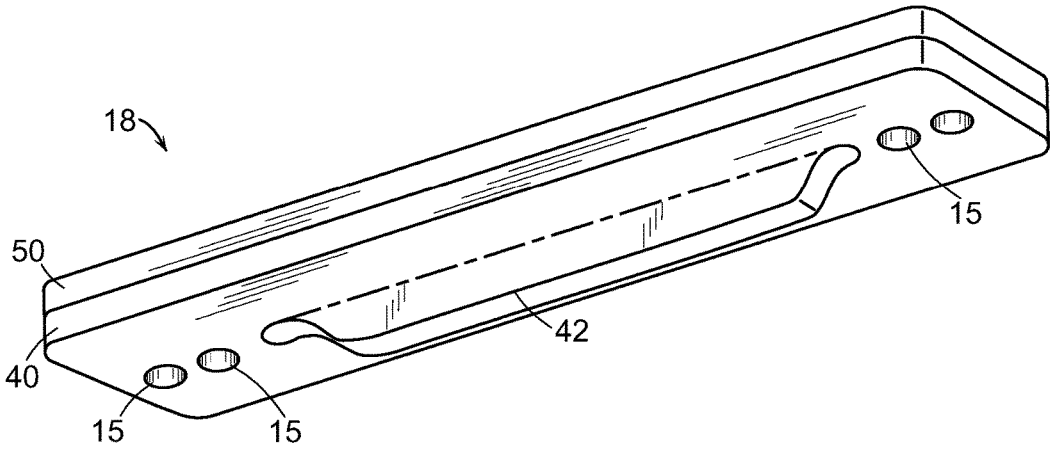
FIG. 3 is a perspective view of the underside of a slat.

FIG. 3 shows an embodiment of slat 18. The underside of the slat base 40 comprises a central lengthwise rib 42, along with mounting holes 15 for fasteners by which the slat may be attached to a belt or other element which interconnects the slats. The rib increases the section modulus to the slat, for resisting deflection due to foot-force.

Figure 4:
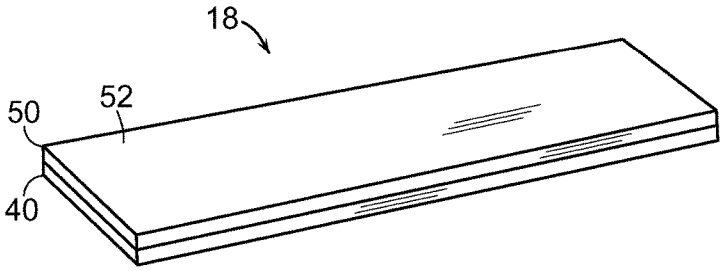
FIG. 4 is a perspective view of a slat, looking down onto the top of the slat.
Figure 5:
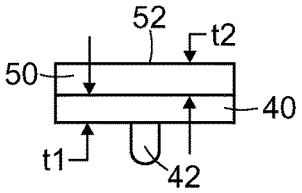
FIG. 5 is an end view of the slat of FIG. 4, with a cover adhesively bonded to the base.
Figure 6:
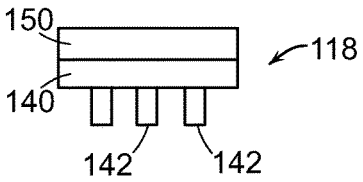
FIG. 6 is an end view of a slat like that of FIG. 4, but having a multiplicity of underside ribs.

FIG. 4 is a perspective view of exemplary slat 18 in its use orientation. The central rib is hidden from view but is shown in FIG. 5 which is an end view of slat 18. Slat 18 has a structural base 40 and a cover 50 (presenting as a top layer in the Figure) which may or may not be structural. The downwardly-extending central lengthwise rib 42 provides lengthwise bending strength to the slat. Alternatively, as shown in FIG. 6, a slat 118 comprising a base 140 and a cover 150 may have a multiplicity of lengthwise running ribs. See Schoenenberger U.S. Pat. No. 5,577,598 and Astilean U.S. Pat. No. 8,690,738 for examples of slats with lengthwise ribs. Still other strengthening features may be used. Alternatively, a slat may have sufficient combination of section modulus and material property so that no rib is present. The bases of slats described herein may comprise optional lightening features, for instance the underside of the base may have honeycomb construction, multiple transverse or diagonal ribs, etc., not shown.

The top surface 52 of cover 50 is the portion of the slat that is presented to the runner's foot or footwear. A cover may be permanently or detachably mated with the base. When a cover is permanently mated with the base, the slat may be constructed in alternative exemplary ways. For example: A cover may be "over-molded", that is, it may be integrally molded onto or around the base after the base has been formed by molding, machining, or otherwise, in a previous process step. Typically, in over-molding there will be a degree of molecular attraction or adhesion between the over-mold (cover) material and the base material. Thus, in this description an over-molded cover is said to be adhesively attached to the base.

Alternatively the cover may be attached to the base by means of a layer of adhesive substance, such as Loctite 3631 Hysol urethane hot melt adhesive (Henkel Corporation, Rocky Hill, Conn., U.S.A.). In a still further option, the cover may alternatively or additionally be attached by mechanical means, described more fully below.

In preferred embodiments of the invention, there is a particular relationship between the character of the material of the slat base and slat cover. Preferably, the cover has strength and hardness which are substantially less than the strength and hardness of the base.

Base 40 of slat 18 is preferably made of injection molded Nylon having a 33% glass content, such as Nylon 6/6 based product number ARC66G33 or the Nylon 1002 base product number 70G33L, both from Arc Resin Corporation, Marietta, Ohio. Both materials and aluminum alloy have been used in prior art slats, in combination with over-molded thermoplastic, such as Thermolast K TC8PAX thermoplastic elastomer (Kraiburg TPE GmbH & Co. KG, Waldkraiburg, Germany). It has a Durometer (Shore A) hardness value of about 80 (measured in accord with ISO 868) and tensile stress (strength) of about 400 psi at 100% strain and about 700 psi at 350% strain breaking point.

Material formed from Arc66G33 Nylon has a flexural modulus of about $12\times10^5$ psi, a flexural strength of about $28\times10^3$ psi and a hardness of Rockwell R121. Material formed of the Arc brand 70G33L resin has a flexural modulus of about $13\times10^5$ psi, a flexural strength of about $38\times10^3$ psi and a hardness of Rockwell M101 measured in accord with ASTM D785. Optionally, a slat may be made of Type 6063T6 aluminum alloy having a modulus of elasticity of about $100\times10^5$ psi and a hardness of Rockwell B 73. Other aluminum alloys may be used. The comparisons between different hardness scales are imperfect. Nonetheless, in that context the foregoing polymer materials have a Shore A hardness number of 80 or more, also categorized as having a Durometer of 80 A or more.

With reference to FIG. 5, in an exemplary slat of the present invention the thickness t1 of the flat portion of the base 40 will be about 0.135 inch and the thickness t2 of the cover 50 will be at least about 0.1 inch, depending on the type of cover, and up to about 0.5 inch and possibly more in the case of turf or cobble surface.

In an embodiment of the invention, slat 18 has a base 40, which is the structural part of the slat, and a cover 50 which is the non-structural top portion of the slat. As used here the term "structural" is a comparative property: The base is the principal load bearing (and thus "structural") part of a slat. While under other circumstances a cover could be considered a structural component, in preferred embodiments of slat, the cover is compliant to external forces and weak compared to the base in resisting typical load born by the slat; the cover does not contribute significantly to structural strength of the component. Thus, in that context and for this description such covers are considered non-structural.

In the present invention, slats are characterized in having one of several unique surfaces and present foot-feel to the runner which is different from that presented by a slat which is wholly formed of an exemplary base polymer or of metal or of wood as embodied in the prior art. The surface texture of a preferred invention slat is also different from the surface of a typical prior art slat which has a plain rubberized molded-on top surface, referred to above.

In the present invention, as elaborated on below, the surface presented to a runner by the top surface of a slat may be one or a combination of (a) simulated turf, (b) simulated cobbled stone or pebbles, (c) ridges of grooves, or (d) surfaces which have a Durometer of less than 80 A, preferably substantially less hard, even as low as 50-70 A (not excluding covers such as simulated turf where conventional hardness cannot be measured)—that is surfaces which have different compressibility under the load of a runner's foot, and virtually no load carrying ability, when compared to the structural plastic or metal of the base of the strut.

Applicants think that the utility of the present invention relates to the biomechanics of running, in particular, to kinematics (how the body moves) and to kinetics (the relationship between body motions and associated forces). These are of interest to people who are serious about running and treadmill use.

In context that this description is necessarily scientifically and analytically superficial, it will be appreciated that insofar as a treadmill providing a meaningful "running experience," factors that would appear important with respect to each slat or to a group of adjacent slats are the friction/traction of the slat surface, the foot-force applied to the slat (referred to a footwork, above), how energy is absorbed/stored/released in the slat, etc.

For all slat surfaces, during use there can be a tendency for generally rearward slip of the foot if the runner is accelerating or maintaining speed, and a tendency for generally forward slip if the runner is decelerating. The actual amount of slip and the orientation of the slip (slip angle) will also depend on how the runner is applying his/her foot force to the slat surface and the nature of frictional engagement of the foot (or any footwear, as applies) with the surface of the slat. The compressibility of the slat surface will affect the magnitude and time-profile of forces applied to the user's foot.

For a given running condition, for a particular slat surface a runner will have resultant force application, and force perception, proprioception of feet, and tactile perception. A typical runner would aim to have all those parameters be sensorially-pleasing and favorable to body health, strength, and the goals of the runner.

From the foregoing, and after the detail description which follows, the extent to which the present invention provides an advantage will be appreciated. For example, when there is a turf surface there will be cushioning and drag on the foot compared to a smooth prior art surface; when there is a cobble surface, the uneven surface provides at least subtle changes in kinetics compared to an even surface; and when there is a compressible/textured surface like that of a track field mat, there will be cushioning and less drag than is provided by turf, but more drag than provided by harder/smoother prior art surfaces. The differing surface texture, compressibility, slip, slip angle, drag, unevenness, energy absorption, energy rebound, etc., all add to the realism of running on a treadmill of the present invention.

It is beyond the scope of the present description to provide details, but it will be appreciated that technical instruments can be used to measure the parameters that have just been mentioned and to quantifiably characterize and or differentiate one slat cover surface from another.

In one embodiment of the invention, the slats have permanently affixed covers; that is they are over-molded or are otherwise attached to the base by heat or adhesive in a bonding step. With such slats, the running surface on a particular treadmill may be changed by replacing the slats that comprise the tread.

In an alternate embodiment of the invention, the cover of each slat is detachable and thus the cover of each slat may be changed to provide a different tread surface of the user's choice without replacing the whole slat.

FIG. 7 to FIG. 11 are somewhat simplified renderings showing in perspective portions of covers which have particular characteristics. The covers of FIG. 7-11 are shown in simplified fashion, i.e., as flat sheets, in context it will be understood that covers may have the configurations described in connection with FIG. 14-18 which are discussed below, and that covers may be shaped in still other ways for the purpose of being detachably or permanently attached to the upper portion of a slat base.

Cover 150, shown in FIG. 7, has a surface that simulates grass as it grows on soil of the earth, familiarly called artificial turf. An exemplary simulated grass covered turf material for cover 150 is a laminate material comprised of a backing made of rubber granules and a surface layer comprised of Nylon strands which are fusion bonded to the backing. An exemplary commercial material is Ecore Athletic Speed & Agility rubber backed turf rolls with itstru-5 Stacked Technology. (Ecore International Co., Lancaster, Pa.). The pile is about one half inch deep and the backing is about $\frac{1}{8}^{th}$ inch thick. The material has a tear strength of less than 200 psi.

Figure 12:
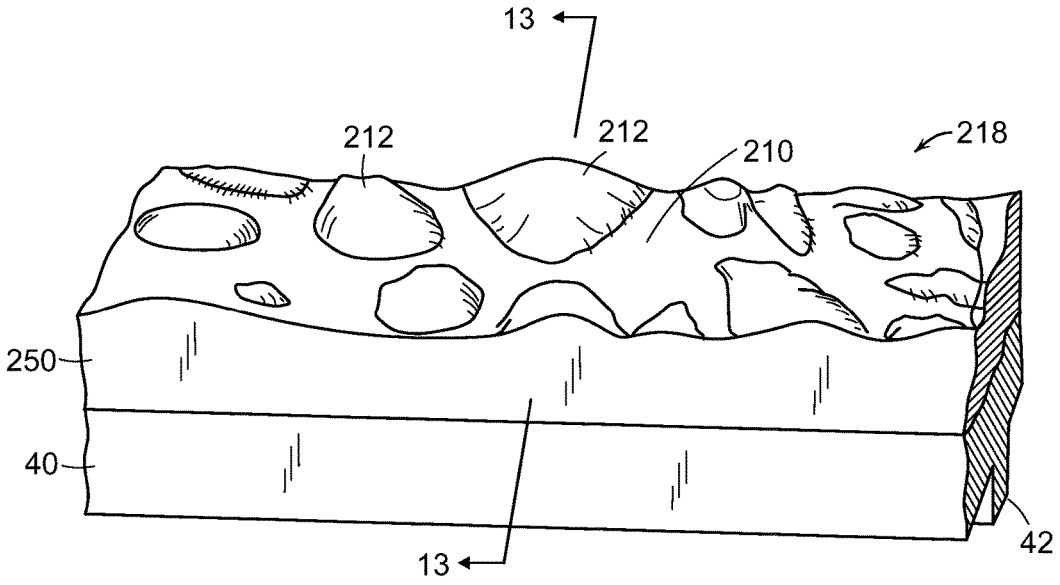
FIG. 12 is a perspective view of a portion of the side of a cobbled surface cover of FIG. 8 which is attached to a base, to show in more detail a cobbled surface.
Figure 13:
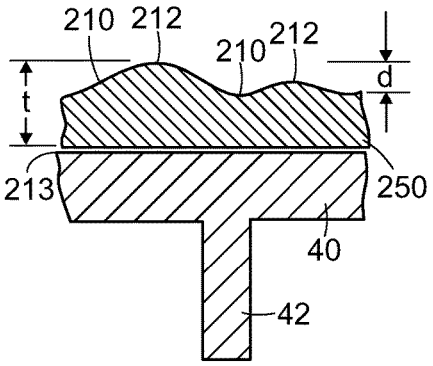
FIG. 13 is a transverse cross section view of a portion of the slat of FIG. 12.

Cover 250, shown in FIG. 8, has a textured surface simulative of small embedded stones (cobbles) or pebbles which are irregularly placed and spaced apart by comparatively smoother regions. The surface of cover 250 is called here a cobbled surface. FIG. 12 is perspective view of part of slat 218 which is comprised of cobbled cover 250 mounted on base 40. FIG. 13 is a cross section through the slat of FIG. 12, showing also adhesive layer 213 which bonds the cover to the upper surface of slat base 40. An exemplary cover 250 is made a rubber material having a Durometer hardness value of 50-60 A. The cobbled surface of the cover has a characteristic roughness which is comprised of irregular small mounds or dimples 212 that extend upwardly a distance d from a gently undulating basic surface contour 210, which alternatively may be substantially planar. Preferably, the mounds preponderantly are at least about 0.15 inch high, up to about 0.5 inch high, relative to the local contour 210. An exemplary cover 250 may have an overall thickness t of about 0.5 inch. "Gently undulating" as applied to the basic surface contour 210 means the surface contour is uneven, rising up and down about plus or minus 10 percent from a mean plane elevation.

FIG. 9 (and the end view of FIG. 10) shows cover 350 having ridges 352 on the top surface, which ridges may continuously or discontinuously run in the lengthwise direction. Preferably, the ridges run generally parallel to the length of the slat. The ridges may be about 0.1 to about 0.2 inches high. Covers like cover 350 may be made of the Ecore EL109 SBR material mentioned next.

FIG. 11 shows a cover 450 which may have an irregular lightly textured surface 452 such as is presented by an artificial running surface associated with sports tracks and used in track and field competitions. An exemplary material is Product No. EL109 SBR rubber flooring (Ecore International, Lancaster, Pa.). The material, typically red in color, has a Durometer A2 hardness value of about 55 (tested in accord with ASTM D2240), and has a tensile strength of about 200 psi (ASTM D412, die C). When used as a cover on a slat is about 3 to 5 mm, up to about 13 mm thick (about 0.12 to 0.2 inch, up to 0.5 inch).

When the covers are permanently attached to the slats, the user of a treadmill can change the running surface of the tread by replacing the whole of the tread or every slat. When the covers are detachable, the user may remove the cover from some or all of the slats and replace the covers with covers that present a different hardness, texture, resilience, etc. to the runner's foot, as exemplified by the covers 150, 250, 250, 450.

The underside surface of covers such as covers 150, 250, 350, 450 preferably are smooth, compared to the cobbled/textured, ribbed, etc. surface which is presented for a runner's feet, ignoring the presence of mechanical engagement features described below.

The exemplary cover materials such as simulated grass turf, gym mat and cobbled surface have low tensile strengths compared to the exemplary bases. Under the predominate load attributed to the weight of the runner, the top side of the base and cover will be subject to compressive forces when there is a tendency for lengthwise bending of a slat. Applicants have not been able to acquire fully meaningful and correlated mechanical properties and do thorough analyses. However, irrespective of how the cover is attached to the base, based on the comparative properties of cover materials versus exemplary glass filled Nylon or aluminum base materials, as recited herein and as well-known, it can be said that the cover does not contribute materially to resisting loads in the exemplary embodiments of the invention, where the slat base and cover dimensions are consistent with the proportions recited in connection with FIG. 5.

Figure 14:
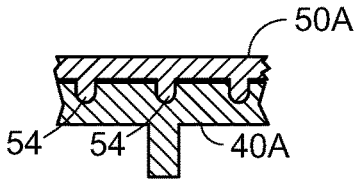
FIG. 14 is transverse cross section of a slat having a detachable cover having features which mate with grooves in the base of the slat.
Figure 16:
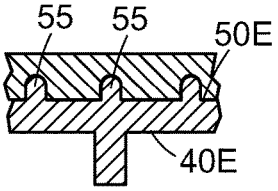
FIG. 16 is transverse cross section of a slat having a detachable cover with recesses which mate with raised ribs or pins on the base of the slat.

FIG. 14 to FIG. 19 show transverse cross sections of different slats, showing how a cover may be detachably secured to the top of a base. In FIG. 14, cover 50A has a plurality of lengthwise fins which snap into place in grooves having undercut sides on the top of the base 40A. Other like-mechanical engagement features may be used in substation of the lengthwise fins. For instance, a plurality of pegs on the underside of the cover may engage a plurality of holes in the top of the base. In carrying out this aspect of the invention, a cover may be comprised of two parts, as shown for cover 50AA in FIG. 15. Cover 50AA is like cover 50A in overall configuration. Cover 50AA is comprised of a support 64 and integral top sheet 66. Support 64 is made of resilient plastic with good strength and properties for downwardly extending features than engage the grooves of the top of the base 40A. Top sheet 66 may be made of less-strong and more resilient material (e.g., a lower Durometer material), for instance a spongy or corklike material. FIG. 16 shows a variation on the configuration of slat in FIG. 14. The detachable cover 50E has cavities which mate with raised ribs 55 or pins on the top of the base 40E.

Figure 17:
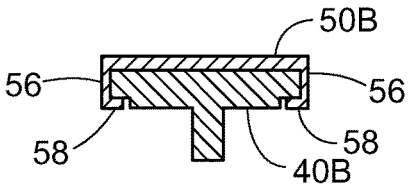
FIG. 17 is a transverse cross section of a slat having a detachable cover which has molded edges that grasp the edges of the base.
Figure 15:
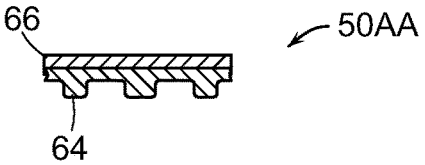
FIG. 15 is a transverse cross section through a cover useful for the embodiment of FIG. 14, where the cover is comprised of a top layer and a support portion for engaging the top surface features of a base.

Cover 50B, shown in FIG. 17, is mounted on base 40B. Cover 50B is C shape and has outer edges 56 which spring resiliently outwardly and then inwardly when the cover is pressed down onto the top of base 40B. Lips 58 at the bottom of the outer edges of cover 50B grasp the underside of the lengthwise edges of the base 40B and mechanically hold the cover in place.

Figure 18:
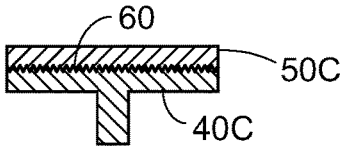
FIG. 18 is a transverse cross section of a slat having a cover that is attached to the base by means of a hook and loop system.

Cover 50C, shown in FIG. 18, is mounted on base 40C. The cover and base are attached to each other by a hook and loop type fasteners 60 (e.g., a Velcro brand fastener system). For example, the fastener hook portion is adhered to the top of the base 40C and fastener loop portion is adhered to the underside of the cover 50C. A user may change the cover of the slat by applying sufficient force to overcome the engagement of a first cover with the base, then attaching a second cover by pressing the cover against the top surface of the base with sufficient force.

Figure 19:
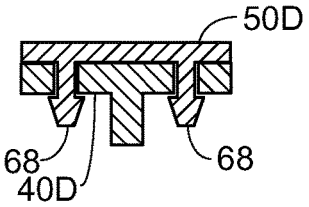
FIG. 19 is a transverse cross section of a slat having a cover that is attached to the base by means of a multiplicity of arrow shaped pins that are integral with the cover.

FIG. 19 shows a cover 50D which has plurality of integral arrowhead shape molded resilient pins 68 which pass through holes in base 40D and are thereby resistant to removal.

Mostly, a runner will desire to have all slats in a treadmill with the same kind of cover, but in the generality of the invention, some slats may have one kind of cover and others may have a different kind of cover.

Foot powered treadmills, compared to powered treadmills, by design have a desirable feature of causing a runner to maintain good posture, for instance, hunching over is not encouraged. The present invention provides further desirable and surprising benefits to a runner. The differently-surfaced slats of the present invention provide a runner with enhanced frictional engagement with the tread, compared to a harder or plain surface, such as metal, hard plastic, or wood. Slats of the present invention, having the kind of covers which are described above, not only feel different and better to a typical runner than the relatively smooth hard surfaces of prior art slats, but they produce desirable effects on the body, its balance and its running form.

For example, when a runner runs on tread comprised of slats which have low Durometer covers, the slat upper part will compress/depress elastically with each footwork. That lessens impact on the joints and other lower body parts, compared to a slat made of a hard plastic or a metal, even when such slat has a thin hard elastomer coating, as in the prior art.

For example, a runner who runs either barefoot or in cleated shoes will have an entirely different interaction with a tread having a simulated turf finish than with a prior art tread comprised of a substantially flat molded surface. With a slat having a cover that provides a simulated turf finish, the pile of the turf will give way under the force of a toe or cleat, and allow penetration of a runner's toes or shoe cleats, as applies, compared to what a hard plastic surface of a prior art slat provides.

As further example, when a runner runs on slats having an uneven cobbled surface that is simulative of a woodland trail surface, the runner is challenged to maintain posture and forward motion despite an inherent slight twisting and turning of the ankle and foot parts. A runner may find that desirable insofar as being "realistic".

Furthermore, a tread comprised of slats having compressible surface covers can be conceived as desirably demanding more from the runner in terms of using his or her postural muscles and in maintaining balance and good form while running.

In certain older kinds of treadmills known in the art, the tread slides over a supportive flat plate that runs between the tops of the rear roller and the front roller, instead of being supported by a plurality of bearings. Slats of the present invention might be used on such types of treadmills as well as on the known kinds of treadmills.

The present invention may be sold as a kit: A treadmill has a tread comprised of interconnected slats. In one kit embodiment, wherein each slat has a base and a cover, and two or more sets of covers are provided, each set having a cover with a particular surface that is different from the surface of the other set. For example, a first set of covers has a turf finish, a second set of covers has a finish typical of the prior art tread surfaces, and optionally there is a third set of covers having a cobbled finish.

In a first kit embodiment, a method of using the treadmill comprises: The covers are permanently attached to bases, and the user unfastens one set of tread slats from opposing side belts and replaces the set with a second set. In a second kit embodiment, the covers are detachable from the bases of the slats. The user pulls each cover from each slat and replaces it with covers from a second set of covers. In each instance, the user then proceeds to run on the treadmill.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A treadmill having an endless loop tread running between a front roller and a rear roller, the tread having an upper portion and a lower portion, the upper portion presenting an endless loop tread surface upon which a user of the treadmill may run, wherein the endless loop tread comprises a multiplicity of interconnected slats, each slat comprising:

a base having a top side and a bottom side, for providing structural strength to the slat; and, a cover, attached to the top side of the base, the cover having a lower first surface in contact with the top side of the base and an upper second surface that forms a portion of said endless loop tread surface;

wherein the upper second surface is an uneven cobbled surface comprising a plurality of spaced apart mounds extending upwardly from a gently undulating basic surface contour, said mounds ranging between 0.15 inch high and 0.5 inch high, as measured from said gently undulating basic surface contour; and wherein said gently undulating basic surface contour is uneven, rising up and down about plus or minus 10 percent from a mean plane elevation.

2. The treadmill of claim 1 wherein the lower first surface of the cover is adhesively attached to the top side of the base.

3. The treadmill of claim 1 wherein the top side of the base of each slat and the lower first surface of the cover of said each slat are disengageably attached to each other by mating engagement features which comprise a cover with a C shape cross section, snap-fitting onto the base.

4. The treadmill of claim 1 wherein for each slat, the top side of the base and the lower first surface of the cover are disengageably attached to each other by mating engagement features which comprise (a) a cover with protuberances that are received in cavities on the top side of the base; (b) a cover having a hook or loop surface which is engaged by a mating loop or hook surface on the top side of the base; or (c) a cover with cavities that receive protuberances on the top side of the base.

5. The treadmill of claim 1 wherein the tread is powered to move the upper portion of the tread from the front roller to the rear roller by footwork of the user; and, wherein the upper portion of the endless loop tread has a concave shape.

* * * * *